US006699165B1

(12) United States Patent
Krieger et al.

(10) Patent No.: US 6,699,165 B1
(45) Date of Patent: Mar. 2, 2004

(54) APPARATUS FOR REMOVING AND TRANSFERRING FOLDING BOXES

(75) Inventors: Eberhard Krieger, Weinstadt (DE); Klaus Stoeckel, Korb (DE); Joseph Weis, Nussloch (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/959,742

(22) PCT Filed: Jan. 12, 2000

(86) PCT No.: PCT/DE00/00081

§ 371 (c)(1),
(2), (4) Date: Jan. 25, 2002

(87) PCT Pub. No.: WO00/67997

PCT Pub. Date: Nov. 16, 2000

(30) Foreign Application Priority Data

May 5, 1999 (DE) ..... 199 20 495

(51) Int. Cl.[7] ..... B31B 1/06
(52) U.S. Cl. ..... 493/122; 493/123; 493/124
(58) Field of Search ..... 493/122, 123, 493/124, 125, 126, 127

(56) References Cited

U.S. PATENT DOCUMENTS 3,952,633 A * 4/1976 Nakai ..... 493/91
4,685,272 A * 8/1987 Kawai et al. ..... 53/389.1
5,078,669 A * 1/1992 Dietrich et al. ..... 493/315
5,176,608 A * 1/1993 Wakabayashi et al. ..... 493/125
5,298,008 A * 3/1994 Decker et al. ..... 493/313
5,704,196 A * 1/1998 Pazdernik et al. ..... 53/458

FOREIGN PATENT DOCUMENTS

DE 2720902 A1 * 11/1978
DE 3941866 A1 * 6/1991

* cited by examiner

*Primary Examiner*—Eugene Kim
(74) *Attorney, Agent, or Firm*—Ronald E. Greigg

(57) ABSTRACT

An apparatus for removing folding box blanks from a folding box magazine and transferring them to between drivers of a conveyor system has a suction rotor with suction cups. The suction rotor is coupled to a four-bar mechanism, which erects the folding box blank along a stationary erecting shunt. By the engagement of the suction cups with a trailing side wall of the folding box blank, which wall stands vertically with reference to the feeding direction, and because of the disposition of the erecting shunt, a high output can be attained with the conveyor system driven incrementally, and folding box blanks can be processed whose front lower edge, in terms of the feeding direction, is located frontmost in the folding box magazine.

11 Claims, 3 Drawing Sheets

APPARATUS FOR REMOVING AND TRANSFERRING FOLDING BOXES

CROSS-REFERENCE TO RELATED APPLICATIONS

This application is a 35 USC 371 application of PCT/DE 00/00081 filed on Jan. 12, 2000.

BACKGROUND OF THE INVENTION

1. Field of the Invention

The invention relates to an apparatus for removing and transferring folding box blanks in a folding box erecting apparatus.

2. Description of the Prior Art

German Patent DE 27 20 902 C2 discloses apparatus for removing and transferring folding boxes in which the pivotable suction cups that pull the folding box blank out of the folding box magazine engage a lower folding box wall, in terms of the erected folding box, that is parallel to the feeding direction. Since the folding box inserted between the drivers of the conveyor system which is in continuous motion is located above the suction cups, the suction cups, in order to remove the next folding box blank from the folding box magazine as soon as possible, must be moved backward horizontally by a certain distance, while at the same time the erected folding box is moved onward by the conveyor system. To attain high output in a conveyor system operating incrementally, a very long horizontal return stroke of the suction cups, which can be achieved only with relative difficulty, would be necessary if the withdrawal of the next folding box blank is to take place during the standstill phase of the conveyor system. Moreover, because of the disposition of its fixed erecting shunt, the known apparatus is suitable only for erected folding box blanks whose front upper edge (in terms of the erected folding box) is disposed at the front in the folding box magazine, in terms of the feeding direction.

From German Patent Disclosure DE 39 41 866 A1, a transfer apparatus is also known which has a suction rotor that moves along a cycloidal path. Such an apparatus is very complicated in design, because of the requisite complex paths of motion with planetary gears.

SUMMARY OF THE INVENTION

The apparatus according to the invention for removing and transferring folding boxes has the advantage over the prior art that even folding box blanks in which the lower, front edge, in terms of the erected folding box in the feeding direction, is disposed at the front in the folding box magazine can be handled. At the same time, the apparatus has a relatively high output, since regardless of the motion of the conveyor system, even with a conveyor system operated incrementally, the suction device can be pivoted immediately after the transfer of the folding box to between the drivers of the conveyor system, without a horizontal return stroke, for removal of the next folding box blank.

To facilitate the erection and to prevent shear forces from changing the position of the folding box blank at the suction cup, a support prong can be provided.

It is especially advantageous to provide additional suction cups, which are disposed in coincidence with a lower folding box wall, in terms of the erected folding box. This makes better, more secure removal of the folding box blanks from the folding box magazine possible. This is especially advantageous in the case of relatively large folding boxes, which as a result cannot open prematurely, making it possible to prevent the setting-up motion from allowing the folding boxes to press into the stack of folding box blanks in the folding box magazine.

The course of motion of the multi-bar linkage mechanism can be controlled especially exactly if the multi-bar linkage mechanism is driven by a servo motor.

An especially high output and uniform opening of the folding boxes is attained if the insertion takes place during the advancement phase of a conveyor system driven incrementally, and the leading edge of the folding box blank is operatively connected to a driver of the conveyor system.

BRIEF DESCRIPTION OF THE DRAWINGS

One exemplary embodiment of the invention is shown in the drawing and will be described in further detail below, with reference to the drawings, in which.

DESCRIPTION OF THE PREFERRED EMBODIMENTS

Figure 1:
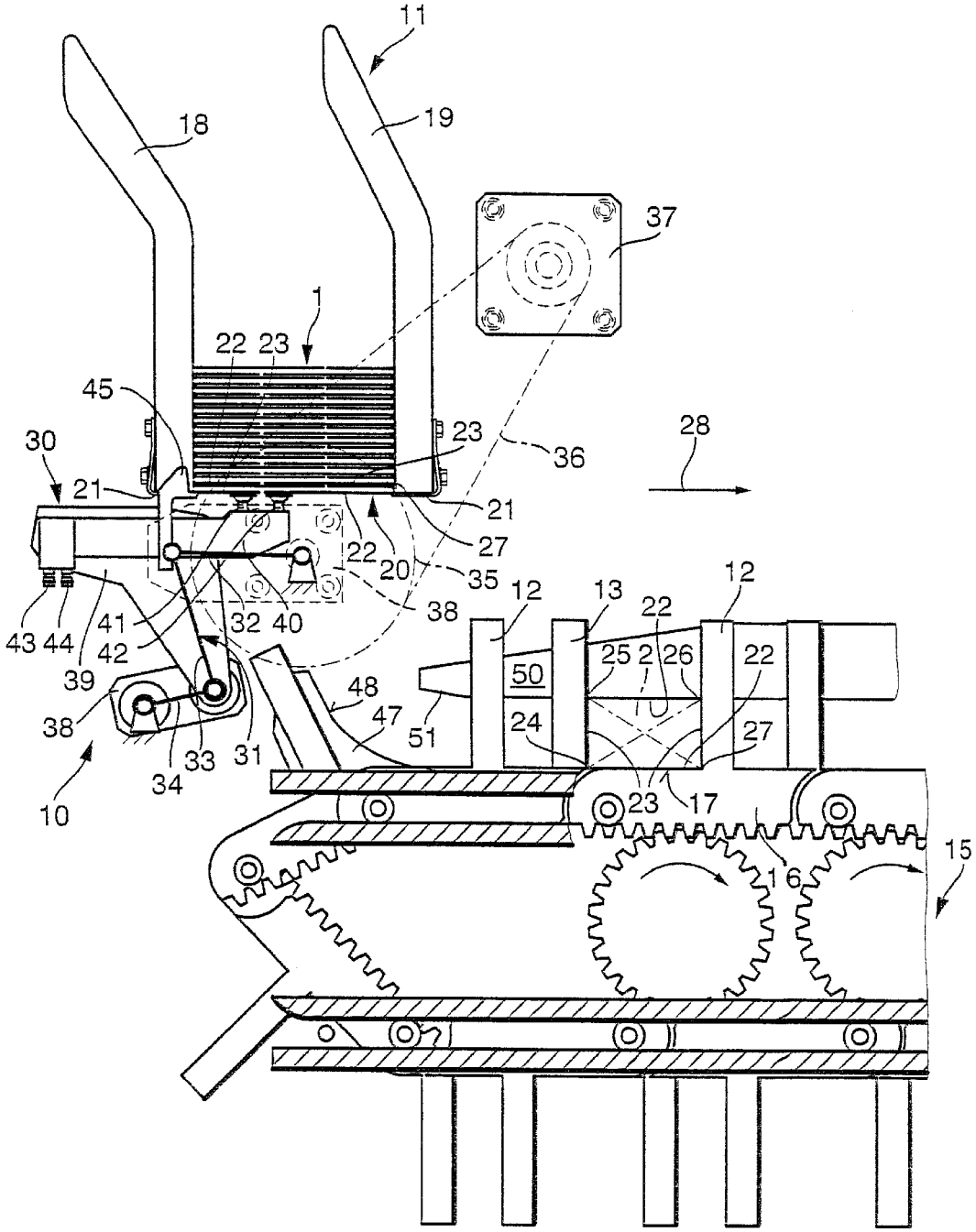
FIGS. 1–3 show an apparatus for removing and transferring folding boxes, in simplified side views during various phases of motion.

In FIG. 1, reference numeral 10 indicates an apparatus for removing folding box blanks 1, lying flat, from a folding box magazine 11 and transferring them, while erecting them at the same time, between cleat-like drivers 12, 13 of a conveyor system 15 driven in increments. The conveyor system 15 is preferably constructed of rack profiles 16, and the drivers 12, 13 are integrally connected to the rack profiles 16. Because of the integral nature, the top side 17 of the rack profiles 16 forms a flat bearing face for the erected folding boxes 2. The structure of this kind of conveyor system 15 is described in further detail in German Patent Disclosure DE 197 31 084 A1.

The folding box magazine 11, disposed above the deflection region of the conveyor system 15, has two side walls 18, 19 that are angled in the upper region. Retention baffles 21, for the lowermost folding box blank 1 in each case, are disposed on the vertically erected, lower end 20 of the folding box magazine. The folding box blanks 1, forming a stack one above the other in the folding box magazine 11, have two wide side walls 22 and two narrow side walls 23, which are variously joined together by way of edges 24, 25, 26, 27. The folding box blanks 1 are all placed flat in the folding box magazine 11 in such a way that the front lower edge 27 of the folding box 2 in terms of the erected folding box 2 in the feeding direction 28, contacts the front side wall 19 of the folding box magazine 11.

Between the folding box magazine 11 and the deflection region of the conveyor system 15, the apparatus 10 has a suction rotor 30. The suction rotor 30 is embodied in the form of a multi-bar linkage mechanism, and in the exemplary embodiment shown as a four-bar mechanism 31. To illustrate the component parts of the four-bar mechanism, a crank 32, coupler 33 and connecting rod 34 are indicated schematically. The crank 32 is coupled to a servo motor 37 via a drive wheel 35 and a toothed belt 36. While the crank 32 and the connecting rod 34 are embodied as shackles 38, the coupler 33 has a bearer 39, which is approximately triangular in side view and has an extension 40. Two rows, preferably each with a plurality of suction cups 41, 42 located parallel to the plane of FIG. 1, are secured to the extension 40. The suction cups 41 and the suction cups 42 are connected to at least one source of negative pressure, not shown, via connections 43, 44 disposed on the bearer 39, in such a way that the suction cups 41, 42 can be subjected to negative pressure separately. What is essential is that one group of suction cups 41 engages one rear, narrow side wall 23 of the folding box blank 1, while the other suction cups 42 engage one lower, wide side wall 22 of the folding box blank 1. Also, the suction cups 41 at the narrow side wall 23 directly engage the edge 24, which has the advantage that folding boxes 2 with narrow side walls 23 of different heights can be handled without adjusting the suction rotor 30.

Also disposed on the bearer 39 is a stationary support prong 45 with a stop 46 for the folding box blank 1; it directly engages the upper, rear edge 25, in terms of the erected folding box 2. To facilitate the erecting of the folding box 2 and at the same time form a guide for the folding box 2, a stationary erecting shunt 47 is disposed in the deflection region of the conveyor system 15. The erecting shunt 47 has a curved guide path 48, which extends up to the level of the top side 17 of the rack profiles 16 and forms a smooth transition from the guide path 48 to the rack profiles 16. Finally, the drivers 12, 13 of the conveyor system 15 cooperate in the region of the upper feed path with a cover rail 50. Together with the drivers 12, 13 and the top side 17 of the rack profiles 16, the cover rail 50 that dips between the drivers 12, 13 forms a rectangular cross section in side view, within which cross section the erected folding box 2 is disposed with positive engagement. The cover rail 50 extends to approximately below one side wall 19 of the folding box magazine 11, and on its end toward the suction rotor 30, on the side toward the top sides 17 of the rack profiles 16, it has a chamfer 51.

Figure 2:
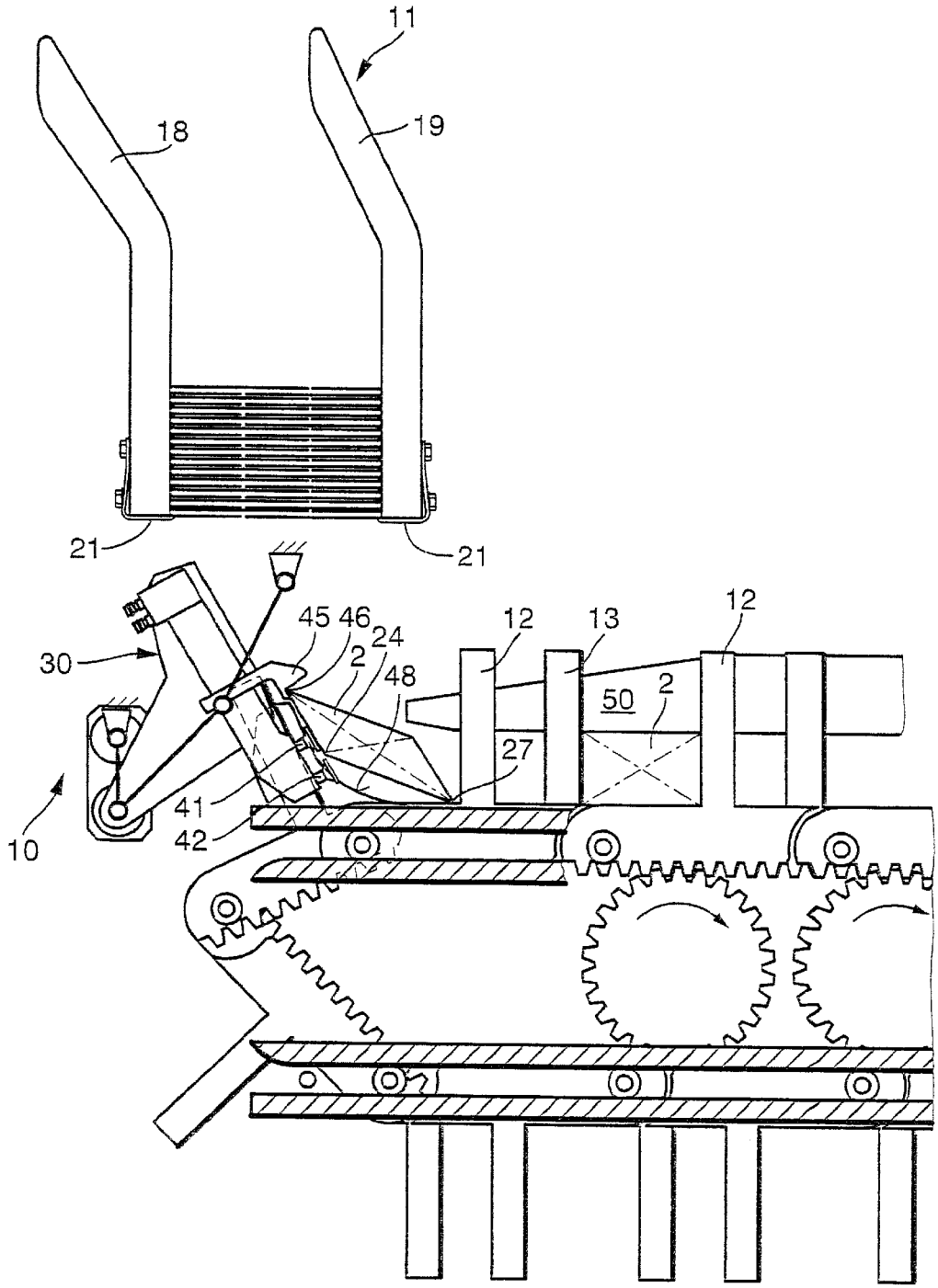

The apparatus 10 described above functions as follows: For pulling the bottommost folding box blank 1 out of the folding box magazine 11, the operative faces of the suction cups 41, 42 are oriented horizontally; one group of suction cups 41 engages the narrow side wall 23 of the folding box blank 1, while the other suction cups 42 engage the wide side wall 22 of the folding box blank 1 (FIG. 1). Once the suction cups 41, 42 have been subjected to negative pressure, the suction cups 41, 42 are moved downward, because of the motion of the suction rotor 30, and at the same time are pivoted clockwise, whereupon the folding box blank 1 is pulled out of the folding box magazine 11. Next, the leading edge 27 of the folding box blank 1 enters into contact with the erecting shunt 47. Because of the oblique position of the suction cups 41, the folding box blank 1 thereupon begins to erect itself. If a force component occurs in the direction of the narrow side wall 23 resting on the suction cups 41, then displacement of the folding box blank 1 on the suction cups 41 is prevented by the stop 46 of the support prong 45, even if only relatively slight negative pressure is applied to the suction cups 41. What is essential here is that during the erection, the suction cups 42 are no longer subjected to negative pressure, so that the wide side wall 22 can be folded out of the plane of the narrow side wall 23. In the ensuing motion of the suction rotor 30, during which the suction rotor moves partway between the rack profiles 16 and its drivers 12, 13, the leading edge 27 moves along the guide path 48 and finally reaches the top side 17 of the rack profiles 16 (FIG. 2). It is also essential that the transfer or insertion of the folding box blank 1 to between the drivers 12, 13 occurs while the incrementally driven conveyor system 15 is just being moved onward by one feeding increment, and the rack profiles 16 are thus in motion at that time. The motion of the suction rotor 30 is adapted to the advancement of the rack profiles 16 in such a way that the front, lower edge 27 of the folding box blank 1 runs up against the leading driver 12. As a result, the folding box blank 1 is diagonally fixed between the rack profiles 16 and the leading drivers 12 on the one hand and the support prong 45 on the other. In addition, the erection motion is generated via the pivoting suction cups 41.

Figure 3:
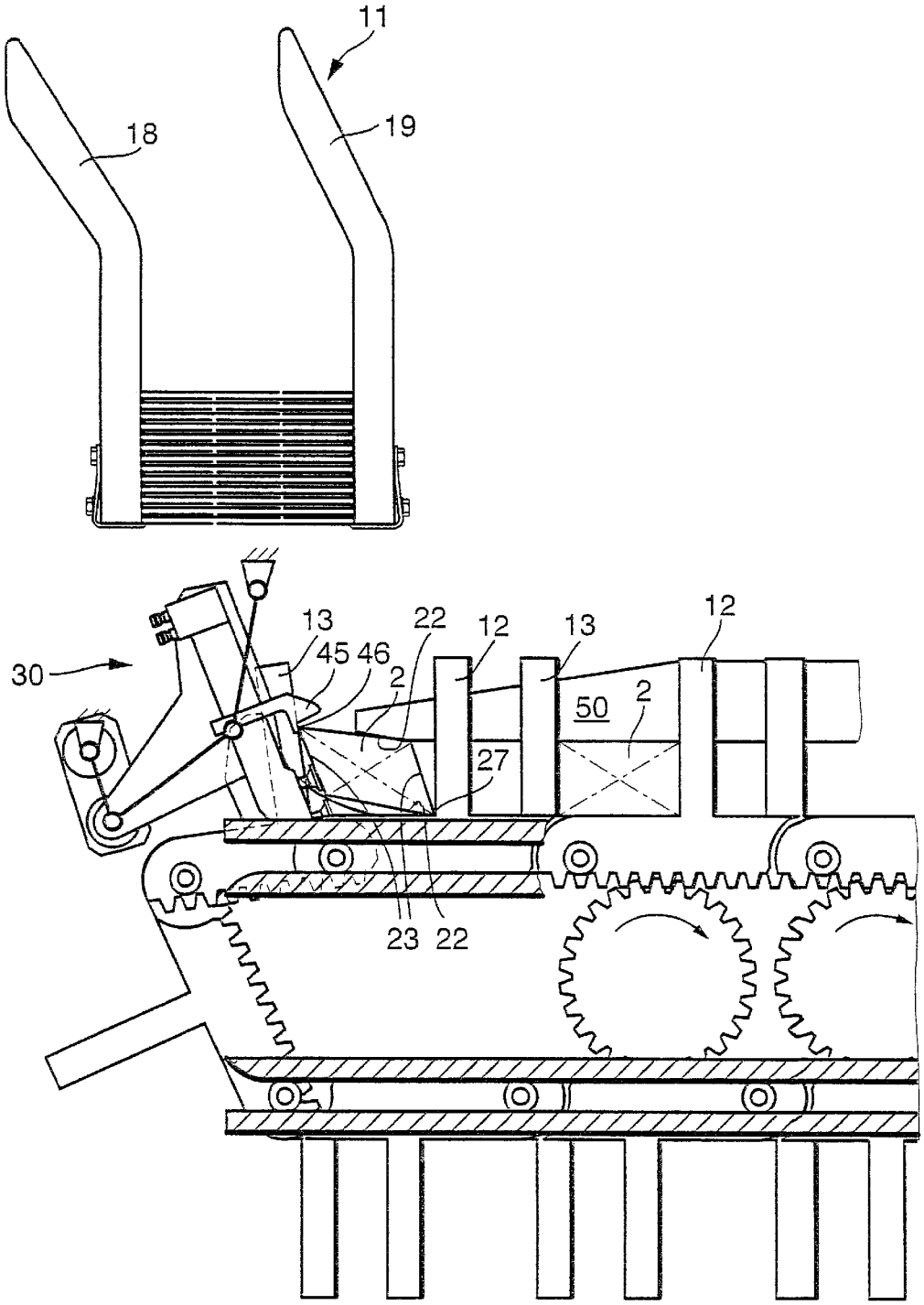

In FIG. 3, the situation is shown just before the folding box blank 1 has been completely erected. The front edge 27 rests on the leading drivers 12, and the folding box blank 1 is moved by the suction rotor 30 at a speed corresponding to the speed of the rack profiles 16. In addition, the upper, wide side wall 22 is guided by the cover rail 50, and the trailing drivers 13 are located near the rear, narrow side wall 23.

For the sake of security, the folding box blank 1 is retained by the suction cups 41 during the entire advancement motion of the rack profiles 16. As soon as the conveyor system 15 is at a standstill, the trailing drivers 13 are also in contact with the rear, narrow side wall 23, so that the folding box 2 is received by positive engagement by the conveyor system 15 and the cover rail 50. Now the negative pressure at the suction cups 41 is shut off, and in order to pull out the next folding box blank 1 from the folding box magazine 11, the suction rotor 30 is moved in the direction of the magazine.

The apparatus 10 can be modified in manifold ways. It is understood that it can also be used with conveyor systems that move continuously. In that case, the release of the folding box blank 1 can take place as soon as the folding box is located between the drivers 12, 13. In addition, the suction cups 42 engaging the wide side wall 22 can be omitted, if the narrow side wall 23 is wide enough for one or more powerful suction cups 41.

The foregoing relates to preferred exemplary embodiment of the invention, it being understood that other variants and embodiments thereof are possible within the spirit and scope of the invention, the latter being defined by the appended claims.

We claim:

1. An apparatus (10) for removing and transferring folding boxes (2), the apparatus comprising a folding box magazine (11), open at the bottom, for holding folding box blanks (1) lying flat, a suction device (30) that has at least one suction cup (41) that is operable to remove the bottommost folding box blank (1) from the folding box magazine (11), said at least one suction device being connected to a multi-bar linkage mechanism (31), a stationary erecting shunt (47) and a conveyor system (15) for erected folding boxes (2), said conveyor system (15) having drivers (12, 13) and at least one cover rail (50), said at least one suction cup (41), with reference to the erected folding boxes (2), being disposed between the drivers (12, 13) and engaging a trailing folding box wall (23) disposed vertically to the conveying direction (28), and said erecting shunt (47) being disposed in the region of the conveyor system (15) and cooperating with a lower, leading edge (27) of the folding box blank (1), said suction device being embodied as a suction rotor (30), and said suction rotor (30) further comprises at least one additional suction cup (42), which is disposed in coincidence with a lower folding box wall (22).

2. The apparatus of claim 1, wherein said suction device is embodied as a suction rotor (30), and further comprising an additional support prong (45) which engages a box edge (25) disposed diagonally from the leading edge (27).

3. The apparatus of claim 1, wherein said at least one suction cup (41) engages the folding box wall (23) directly at the lower, trailing edge (24), that is, lower in terms of the erected folding box (2).

4. The apparatus of claim 2, wherein said at least one suction cup (41) engages the folding box wall (23) directly at the lower, trailing edge (24), that is, lower in terms of the erected folding box (2).

5. The apparatus of claim 1, wherein said multi-bar linkage mechanism is a four-bar mechanism (31).

6. The apparatus of claim 2, wherein said multi-bar linkage mechanism is a four-bar mechanism (31).

7. The apparatus of claim 1, wherein said multi-bar linkage mechanism is driven by a servo motor (37).

8. The apparatus of claim 1, wherein said conveyor system (15) is driven incrementally; wherein the insertion of the folding boxes (2) between the drivers (12, 13) is effected essentially during an advancement motion of the conveyor system (15); and wherein upon insertion, the leading edge (27) of the folding boxes (2) is operatively connected to a leading driver (12).

9. The apparatus of claim 2, wherein suction cups (41, 42) are triggerable separately.

10. The apparatus of claim 4, wherein suction cups (41, 42) are triggerable separately.

11. The apparatus of claim 1, wherein, when the folding boxes are held in the magazine the lower box wall and the box wall which will become the trailing wall are held in a condition so that these walls are coplanar, so that the at least one suction cup (41) and the additional suction cup (42) can easily pull a box from the magazine, and once the box is removed from the magazine suction can be removed from the additional suction cup (42).

* * * * *

UNITED STATES PATENT AND TRADEMARK OFFICE

CERTIFICATE OF CORRECTION

PATENT NO. : 6,699,165 B1 
DATED : March 2, 2004
INVENTOR(S) : Eberhard Krieger, Klaus Stoeckel and Joseph Weis It is certified that error appears in the above-identified patent and that said Letters Patent is hereby corrected as shown below:

Title page,
Item [56], References Cited, FOREIGN PATENT DOCUMENTS, should read as follows:

-- FOREIGN PATENT DOCUMENTS

| | | | |
|---|---|---|---|
| DE | 2720902 | A1 | 11/1978 |
| DE | 3941866 | A1 | 6/1991 |
| DE | 19731084 | A | 1/1999 |
| EP | 0331325 | A | 9/1989 -- |

Signed and Sealed this

Twenty-fifth Day of May, 2004

JON W. DUDAS
*Acting Director of the United States Patent and Trademark Office*